United States Patent [19]

Rosier

[11] Patent Number: 5,036,572

[45] Date of Patent: Aug. 6, 1991

[54] ROTATABLE NOSE ASSEMBLY FOR SETTING FASTENERS

[75] Inventor: Hendrik E. Rosier, Kingston, N.Y.

[73] Assignee: Huck Manufacturing Company, Irvine, Calif.

[21] Appl. No.: 563,134

[22] Filed: Aug. 6, 1990

[51] Int. Cl.[5] ..... B21J 15/10

[52] U.S. Cl. ..... 29/243.522

[58] Field of Search ..... 72/453.17, 391.2, 391.4; 29/243.521, 243.522, 243.529

[56] References Cited

U.S. PATENT DOCUMENTS

| | | | |
|---|---|---|---|
| 3,107,806 | 10/1963 | Van Hecke et al. | 29/243.522 |
| 3,406,557 | 10/1968 | Harris | 29/243.521 |
| 3,475,945 | 11/1969 | Chirco | 29/243.522 |
| 3,534,580 | 10/1970 | Chirco | 72/453.17 |
| 3,605,478 | 9/1971 | Chirco | 29/243.529 |
| 4,796,455 | 1/1989 | Rosier | 72/391.2 |
| 4,813,261 | 3/1989 | Rosier | 29/243.522 |
| 4,896,522 | 1/1990 | Rosier | 29/243.521 |

*Primary Examiner*—David Jones

*Attorney, Agent, or Firm*—Lawrence J. Shurupoff

[57] ABSTRACT

A tool for swaging a fastener collar around a grooved fastener pin to secure two or more work pieces together includes an axially elongated anvil and collet that can slide back and forth to perform the swaging operation. Localized side areas of the anvil and collet are cut away to define a clearance space that can fit around projecting portions of the work that might otherwise obstruct the tool against proper placement of the anvil against the fastener collar. The anvil and collet are rotatable as a unit to enable the clearance space to be oriented at any desired location around the anvil circumference.

10 Claims, 1 Drawing Sheet

ROTATABLE NOSE ASSEMBLY FOR SETTING FASTENERS

BACKGROUND OF THE INVENTION

1. Field of the Invention

This invention relates in general to tools for swaging or setting fastener collars around grooved fastener pins and particularly relates to a rotatable anvil and collet assembly formed with a work clearance zone for accessing hard to reach fasteners.

2. Description of Prior Developments

Tools used to swage fastener collars around fastener pins commonly include a hand-held tool body that houses a hydraulic cylinder within which a double acting piston is moved by hydraulic pressure to operate a collet and jaw assembly. An anvil is connected to the cylinder portion of the tool in surrounding relation to the collet for swaging the collar over the pin.

With the jaw assembly gripping a grooved fastener pin, the application of hydraulic pressure causes the tool cylinder to recoil relative to the piston. This causes the free or nose end of the anvil to travel axially along and over the fastener collar so as to swage the collar member into the grooves on the fastener pin. This swaging operation is sometimes referred to as setting a fastener.

Fasteners of the above noted type are used extensively in the aircraft industry to interconnect airframe structural members. These structural members can have various cross sectional configurations, such as U and J shaped channels. It is often necessary to locate the fasteners behind flanges formed on the structural members and in such cases the space required for accommodating the nose end of the fastener tool may be partially obstructed by the flanges.

In order to utilize such fasteners where space is limited, such as in the space between the flanges on a channel type structural member, various tools having offset nose assemblies have been developed. For example, U.S. Pat. Nos. 4,813,261 and 4,896,522 disclose push-pull tools having offset nose assemblies. In each of these patented arrangements the offset nose assembly is capable of rotary adjustment around the piston axis, such that the tool can be held in a relatively comfortable position by the tool operator. This is the case even when the channel member or other structural member is in an overhead location or in some other location where the tool operator would have to twist his or her arm or body if the offset nose assembly had a fixed, non-rotary mounting with respect to the tool body.

The tools shown in U.S. Pat. Nos. 4,813,261 and 4,896,522 perform satisfactorily in most situations. However, the offset nature of these nose assemblies tends to increase tool manufacturing costs. Also, the offsetting of the nose assemblies from the piston axis tends to introduce cantilever forces within the tool, as outlined in the specification of U.S. Pat. No. 4,813,261. As a result, the tool components have to be made somewhat thicker and stronger, thereby increasing the weight of the tool.

Light tool weight and small tool size are desirable characteristics for this type of tool because a lighter tool is easier to handle and manipulate. Moreover, a lighter tool can be used for a longer period of time before the tool operator experiences hand or wrist fatigue. Accordingly, a need exists for a light weight in-line rotatable nose assembly which is capable of accessing hard to reach fasteners.

SUMMARY OF THE INVENTION

The present invention has been developed to fulfill the needs noted above and is directed to a fastener swaging tool having an elongated tubular anvil connected to a hydraulic cylinder portion of the tool, and an elongated collet telescopically arranged within the tubular anvil. The collet is connected to a piston portion of the tool and a pin-gripping jaw structure is arranged within the collet. When setting a fastener, a fluid powered piston is moved in one direction within the tool cylinder as a fastener pin is rigidly held by the jaw assembly to enable the anvil to advance away from the piston. This motion allows the anvil to swage a fastener collar into circumferential grooves formed in the fastener pin.

As one object of the invention, side areas of the anvil and collet are cut away to define a radial work clearance space having a depth dimension equivalent to the combined wall thicknesses of the anvil and collet. The clearance space allows the tool to fit its nose end into restricted spaces such as the space between the flanges of a work piece having a channel shaped cross section.

Although the invention has some of the characteristics of the offset nose tools shown in aforementioned U.S. Pat. Nos. 4,813,261 and 4,896,522, the tool is, in contrast, an in-line tool wherein the nose assembly is in axial alignment with the actuating piston. The tool can therefore be built as a relatively low cost light weight device. piston assembly. This connection allows the work clearance zone along the side surface of the anvil to be oriented at any desired location around the anvil circumference.

The rotary connection enables the tool to be held in a relatively comfortable position, with the clearance zone selectively and adjustably oriented to fit over the edge of a flange on an associated work piece. The tool operator is not required to twist his or her arm or body in order to achieve the desired orientation of the clearance space around the edge of the work piece flange. The desired orientation is easily achieved by manually rotating the anvil-collet assembly relative to the tool body.

IN THE DRAWINGS

DESCRIPTION OF A PREFERRED EMBODIMENT OF THE INVENTION

Figure 1:
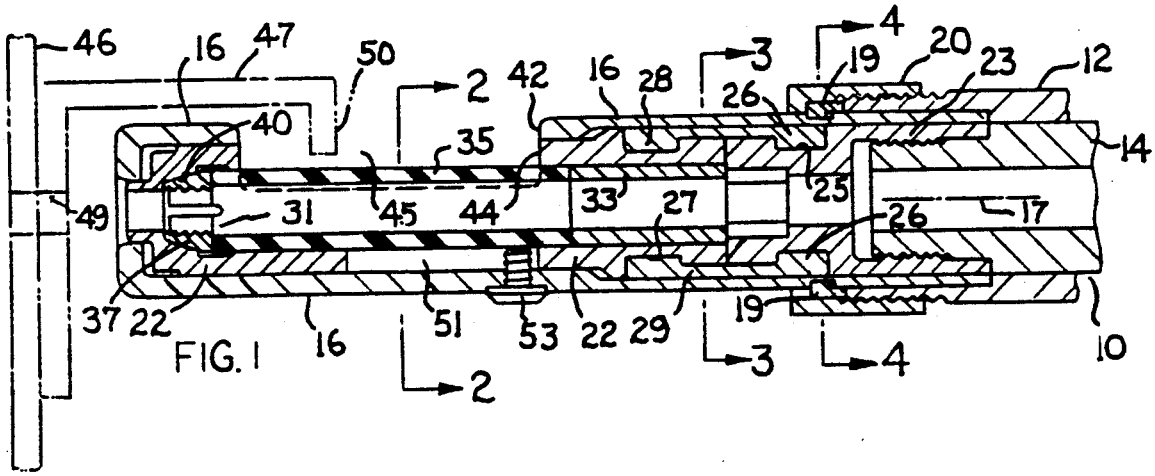
FIG. 1 is a fragmentary longitudinal sectional view taken through a push-pull tool embodying the invention.
Figure 5:
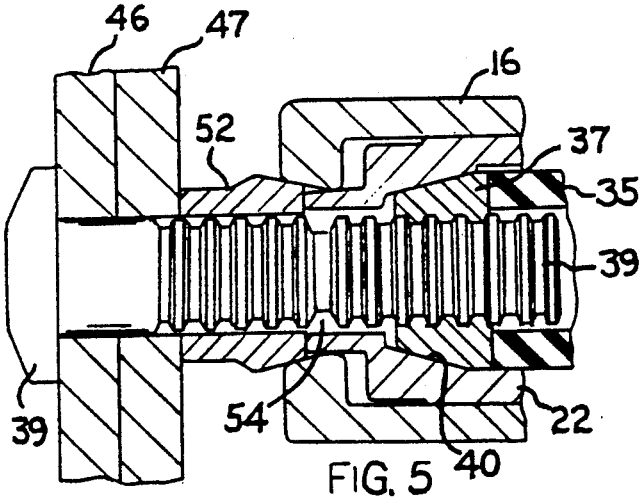
FIG. 5 is an enlarged view of structural details used in the FIG. 1 tool. The tool is shown in a position for swaging a fastener collar onto a grooved fastener pin extending through aligned openings in two work pieces.
Figure 4:
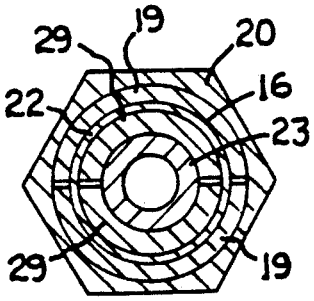
FIG. 4 is a sectional view taken on line 4—4 in FIG. 1.

FIG. 1 fragmentarily illustrates a push-pull tool 10 for swaging a fastener collar around a circumferentially grooved fastener pin. An illustrative pin-collar orientation is depicted in FIG. 5. Tool 10 includes a main tool body constructed similarly to the tool body shown in U.S. Pat. No. 4,813,261. The tool body includes a cylinder 12 that forms an internal guide surface for a hydraulic piston 14.

The piston is shown in its leftmost position preparatory to the start of a pin fastening or setting operation during which the piston moves in a left-to-right direction. Viewed in a different sense, cylinder 12 moves leftwardly during the pin-setting operation since the piston-cylinder motions are relative to one another.

An annular axially elongated anvil or housing 16 extends leftwardly from cylinder 12. A special connection mechanism joins the anvil to the cylinder such that the anvil acts as a rigid axial extension of the cylinder while at the same time the anvil is free to rotate around cylinder axis 17 independently of the cylinder. The connection mechanism includes a first split ring structure 19 having an L-shaped cross section as seen in FIG. 1. Two semicircular ring half sections of the first ring structure 19 extend into an annular groove in the outer surface of anvil 16.

A nut 20 is threaded onto a threaded area of cylinder 12 to engage the left end surface of each ring half section to prevent the anvil from axially separating from the cylinder. Ring structure 19 is provided with axial clearance with respect to the associated groove in anvil 16 thereby, enabling the anvil to rotate freely around the cylinder axis 17 without axial displacement. A tubular collet 22 is axially aligned with piston 14 so that the collet moves back and forth with the piston during each power stroke of the tool. The collet is provided with axial slidable guidance on the inner surface of anvil 16.

A second connection mechanism joins collet 22 to piston 14 so that the collet can rotate freely around axis 17 independently of the piston. This second connection mechanism includes an annular tubular adaptor 23 having an internally threaded section threaded onto piston 14.

An annular outwardly facing groove 25 is formed in the adaptor 23 beyond the left end of piston 14. Collet 22 is formed with another annular outwardly-facing groove 27 near its right end. A second split ring structure 29 extends over and around the adjacent ends of adaptor 23 and collet 22. The second ring structure includes two semi-cylinder half sections that cooperatively encircle end portions of the adaptor and collet. Each ring half section has inturned flanges 26 and 28 extending into grooves 25 and 27 in the adaptor and collet, such that the second ring structure acts as a connecting link between the adaptor and collet.

The adaptor 23 and split ring structure 29 serve as a connection mechanism between piston 14 and collet 22, such that the collet acts as an axial extension of the piston. Flanges 26 and 28 are provided with clearance with respect to grooves 25 and 27 to allow the collet to rotate freely around axis 17 without arial displacement independently of the piston.

A jaw assembly 31 is located within collet 22 in axial alignment with piston 14. The jaw assembly may include a rigid metal tube 33, an elastomeric tube 35, and multi-piece chuck jaws 37 having internal ribs adapted to fit into grooves in a fastener pin 39 as seen in FIG. 5. Opposite ends of elastomeric tube 35 are bonded or otherwise connected to the metal members 33 and 37. During a fastener setting operation, elastomeric tube 35 will be under relatively light axial loadings, due to the fact that collet 22 has a frusto-conical surface 40 engaged against the mating surface areas of chuck 37.

Figure 2:
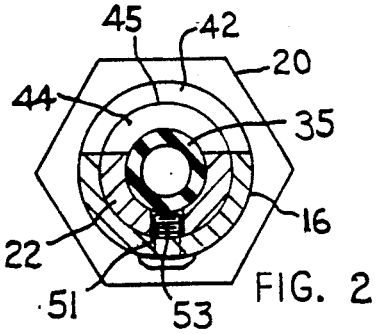
FIG. 2 is a sectional view taken on line 2—2 in FIG. 1.
Figure 3:
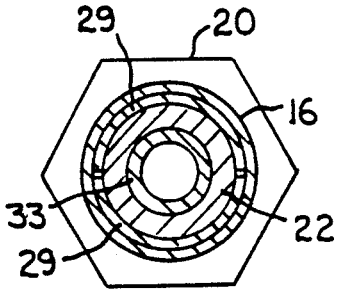
FIG. 3 is a sectional view taken on line 3—3 in FIG. 1.

Anvil 16 has an intermediate section thereof cut away, as at 42. Similarly, collet 22 has an intermediate section thereof cut away, as at 44. The two cut away sections cooperatively form a radial clearance space 45 having a depth dimension equivalent to the combined wall thicknesses of the anvil and collet. Cut away sections 42 and 44 have axial dimensions extending along a substantial portion of the anvil length, as seen in FIG. 1. As seen in FIGS. 1 and 2, the clearance space 45 defined by cut away sections 42 and 44 extends partially around and exposes a circumferential portion of the jaw assembly. Clearance space 45 is designed to fit over and around those portions of a work piece that might obstruct placement of anvil 16 in axial alignment with the fastener holes in the work pieces. FIG. 1 shows, in phantom lines, two work pieces 46 and 47 having aligned circular openings 49 oriented to receive a fastener pin similar to pin 39 shown in FIG. 5. Work piece 47 has a channel shaped cross section that includes a flange 50. Due to the clearance space 45 formed in the side area of the tool, the flange 50 does not prevent the tool from being properly axially aligned with openings 49 in the two work pieces.

Proper operation of the tool requires that cut away sections 42 and 44 be in radial or circumferential registry. Otherwise, clearance space 45 will not likely have a sufficient radial depth to accommodate the obstructions noted above. The collet 22 is axially keyed to anvil 16 by means of an axial slot 51 formed in the collet wall, and a threaded pin 53 extending through the anvil wall into the slot. The pin-slot combination ensures that the collet can have axial motion relative to the anvil, while the collet-anvil assembly is rotatable as a unit around axis 17.

With the push-pull tool held in the most comfortable position available, the anvil-collet assembly can be manually rotated to a position wherein the clearance space 45 is oriented at any desired location around the anvil circumference. The clearance space can thereby fit around flanges or other work piece obstructions that might otherwise require the tool to be held in an awkward or uncomfortable position or which may prevent setting of the fasteners.

FIG. 5 illustrates generally how the tool is used. Anvil 16 is located with its end surface engaged against a collar 52 that encircles a grooved fastener pin 39. As chuck jaws 37 grip the ribs on pin 39, the tool is operated so that hydraulic pressure is applied to piston 14 in a direction tending to move the piston in a rightward direction. Collet surface 40 exerts a rightward force on the chuck jaws 37 which enables the chuck jaws to tightly grip pin 39.

The interengagement between the chuck jaws 37 and pin 39 prevents piston 14 from moving rightwardly. Thus, cylinder 12 and anvil 16 are forced to move leftwardly, such that the end face on anvil 16 travels over collar 52, thereby radially swaging the collar into the grooves in pin 39. Eventually, pin 39 is sufficiently tensioned so that it breaks off at a relatively deep break off groove 54.

The action of jaw assembly 31 and anvil 16 is conventional. The invention relates to the cut away areas 42 and 44 that cooperatively form clearance space 45, together with the rotary connections between the anvil-collet assembly and the cylinder-piston assembly, whereby clearance space 45 can be oriented to any desired location around the anvil circumference. Anvil 16 is rotatably connected to cylinder 12 by means of the split ring structure 19 and nut 20. Collet 22 is rotatably connected to piston 14 by means of adaptor 23 and split ring structure 29.

The separate rotary connections do not interfere with the axial motion of the piston relative to the cylinder. Collet 22 acts as an axial extension of the piston, while anvil 16 acts as an axial extension of cylinder 12. The keying arrangement at 51, 53 enables the anvil and collet to rotate freely as a single unit. At the same time the collet is free to slide axially within the anvil.

The drawings show one form that the invention can take. It will be appreciated that some structural variations in the tool can be made while still practicing the invention.

I claim:

1. A rotatable nose assembly for use with a fastener tool which includes an actuation cylinder and an actuating piston having an axis and being axially movable within the cylinder, said assembly comprising:

a housing;

a collet slidably arranged with said housing;

aid housing having a section thereof cut away around a portion of its circumference, said collet having a section thereof cut away around a portion of its circumference said cut away sections being in registry to define a radial work clearance zone;

first connector means for joining said housing to the actuation cylinder so that the housing is free to rotate around the piston axis independently of said actuation cylinder and without axial displacement with respect to the actuation cylinder; and second connector means comprising a split ring structure for joining said collet to said piston so that the collet is free to rotate around the piston axis independently of said piston and without axial displacement with respect to said piston, wherein said housing and said collet are rotatable as a unit around the piston axis so that the radial clearance zone can be oriented at any desired circumferential location around the housing.

2. The assembly of claim 1, further comprising keying means keying said collet means to said housing such that said collet can slid axially within said housing while said collet is prevented from rotating relative to said housing.

3. The assembly of claim 2, wherein said keying means comprises an axial slot provided in said collet and a pin extending from said housing into said axial slot.

4. The assembly of claim 1, wherein said second connector means comprises an annular adaptor connectable to said piston, said adaptor having a first outwardly facing annular groove therein, said collet having a second outwardly facing groove therein, and said split ring structure having axially spaced inturned flanges extending into said grooves to connect said collet to said adaptor.

5. The assembly of claim 1, further comprising jaw means provided within said collet.

6. The assembly of claim 1, wherein said second connector means comprises an annular adaptor connectable to said piston, said adaptor having an end surface facing away from said piston and said collet and said jaw means having end surfaces engaged with said end surface of said adaptor.

7. A rotatable nose assembly for use with a fastener setting tool which includes an actuation cylinder and an actuating piston having an axis and being axially movable within the cylinder, said assembly comprising:

an anvil;

a collet slidably arranged within said anvil;

said anvil having a section thereof cut away around a portion of its circumference, said collet having a section thereof cut away around a portion of its circumference, said cut away sections being in registry to define a radial work clearance zone;

first connector means for joining said anvil to the actuation cylinder so that the anvil is free to rotate around the piston axis independently of said actuation cylinder; and second connector means for joining said collet to said piston so that the collet is free to rotate around the piston axis independently of said piston wherein said anvil land collet are rotatable as a unit around the piston axis so that the radial clearance zone can be oriented at any desired location around the anvil circumference, said second connector means comprising an annular adaptor connectable to said piston, said adaptor having a first outwardly facing annular groove therein, said collet having a second outwardly facing groove therein, and a split ring structure having axially spaced inturned flanges extending into said grooves to connect said collet to said adaptor.

8. A rotatable nose assembly for use with a fastener setting tool which includes an actuation cylinder and an actuating piston having an axis and being axially movable within the cylinder, said assembly comprising:

an anvil;

a collet slidably arranged within said anvil;

jaw means provided within said collet;

said anvil having a section thereof cut away around a portion of its circumference, said collet having a section thereof cut away around a portion of its circumference, said cut away sections being in registry to define a radial work clearance zone;

first connector means for joining said anvil to the actuation cylinder so that the anvil is free too rotate around the piston axis independently of said actuation cylinder; and second connector means for joining said collet to said piston so that the collet is free to rotate around the piston axis independently of aid piston wherein said anvil and collet are rotatable as a unit around the piston axis so that the radial clearance zone can be oriented at any desired location around the anvil circumference, said second connector means comprising an annular adaptor connectable to said piston, said adaptor having an end surface facing away from said piston and said collet and said jaw means having end surfaces engaged with said end surface of said adaptor.

9. A rotatable nose assembly for use with a fastener tool which includes an actuation cylinder and an actuating piston axially having an axis and being movable within the cylinder, said piston having an axis, said assembly comprising:

a housing;

a collet slidably arranged with said housing;

a jaw assembly provided within said collet;

said housing having a section thereof cutaway around a portion of its circumference, said collet having a section thereof cut away around a portion of its circumference, said cut away sections being in registry to define a radial work clearance zone extending partially around and exposing a circumferential portion of said jaw assembly;

first connector means for joining said housing to the actuation cylinder so that said housing is free to rotate around the piston axis independently of said actuation cylinder; and second connector means for joining said collet to said piston so that the collet is free to rotate around the piston axis independently of said piston wherein said housing and said collet are rotatable as a unit around the piston axis so that the radial clearance zone can be oriented at any desired location around the anvil circumference.

10. The assembly of claim 10, wherein said jaw assembly extends axially across said work clearance zone.

* * * * *

UNITED STATES PATENT AND TRADEMARK OFFICE

CERTIFICATE OF CORRECTION

PATENT NO. : 5,036,572

DATED : August 6, 1991

INVENTOR(S) : Hendrik E. Rosier

It is certified that error appears in the above-identified patent and that said Letters Patent is hereby corrected as shown below:

Column 2, line 32, delete "piston assembly".
Column 3, line 26, after "thereby" delete --,--.
Column 3, line 56, delete "arial" and insert --axial--.
Column 5, line 21, Claim 1, delete "with" and insert --within--.
Column 5, line 22, Claim 1, delete "aid" and insert --said--.
Column 5, line 43, Claim 2, delete "slid" and insert --slide--.
Column 6, line 15, Claim 7, delete "land" and insert --and--.
Column 6, line 39, Claim 8, delete "too" and insert --to-.
Column 6, line 44, Claim 8, delete "aid" and insert --said--.
Column 6, line 60, Claim 9, delete "with" and insert --within--.

Signed and Sealed this

Thirteenth Day of April, 1993

*Attest:*

STEPHEN G. KUNIN

*Attesting Officer*

*Acting Commissioner of Patents and Trademarks*